US007025077B2

(12) United States Patent
Vogel

(10) Patent No.: US 7,025,077 B2
(45) Date of Patent: Apr. 11, 2006

(54) HEAT EXCHANGER FOR INSTANT WARM WATER

(75) Inventor: John D. Vogel, Columbus, IN (US)

(73) Assignee: Masco Corporation of indiana, Indianapolis, IN (US)

( * ) Notice: Subject to any disclaimer, the term of this patent is extended or adjusted under 35 U.S.C. 154(b) by 0 days.

(21) Appl. No.: 10/940,514

(22) Filed: Sep. 14, 2004

(65) Prior Publication Data

US 2006/0054217 A1 Mar. 16, 2006

(51) Int. Cl.
*F17D 1/18* (2006.01)
*F16L 53/00* (2006.01)

(52) U.S. Cl. ..... 137/13; 137/334; 137/337; 137/340; 236/12.11; 126/362

(58) Field of Classification Search ..... 137/340, 137/337, 334, 13; 236/12.11; 126/362
See application file for complete search history.

(56) References Cited

U.S. PATENT DOCUMENTS

| | | | | |
|---|---|---|---|---|
| 3,111,942 | A * | 11/1963 | Miller | 122/13.3 |
| 3,232,336 | A * | 2/1966 | Leslie et al. | 236/12.11 |
| 4,077,545 | A | 3/1978 | Karls | |
| 4,331,292 | A | 5/1982 | Zimmer | |
| 5,072,717 | A | 12/1991 | Laing et al. | |
| 5,678,734 | A | 10/1997 | Walker | |
| 5,735,291 | A | 4/1998 | Kaonohi | |
| 5,775,372 | A | 7/1998 | Houlihan | |
| 5,819,785 | A | 10/1998 | Bardini | |
| 5,904,291 | A | 5/1999 | Knapp | |
| 5,918,625 | A | 7/1999 | Ziehm | |
| 5,944,221 | A | 8/1999 | Laing et al. | |
| 5,983,922 | A * | 11/1999 | Laing et al. | 137/338 |
| 6,026,844 | A * | 2/2000 | Laing et al. | 137/337 |
| 6,094,524 | A | 7/2000 | Riley | |
| 6,227,235 | B1 | 5/2001 | Laing et al. | |
| 6,453,938 | B1 * | 9/2002 | Ebster | 137/337 |
| 6,588,377 | B1 | 7/2003 | Leary et al. | |
| 2003/0221254 | A1 | 12/2003 | McNemey et al. | |

* cited by examiner

*Primary Examiner*—A. Michael Chambers
(74) *Attorney, Agent, or Firm*—Baker & Daniels LLP

(57) ABSTRACT

A method and apparatus for providing heated water to a hot water supply line positioned intermediate a hot water supply and a faucet.

20 Claims, 3 Drawing Sheets

HEAT EXCHANGER FOR INSTANT WARM WATER

BACKGROUND AND SUMMARY OF THE INVENTION

The present invention relates to a water supply for faucets providing warm or hot water. More specifically, the present invention relates to faucets providing warm or hot water where the water outlet is spaced apart from the water heating source.

Typical faucets utilize a hot water supply and a cold water supply. Hot water is typically heated by a water located remotely from the faucet. Hot water is transported from the water heater to the faucet via pipes. Such transport includes some loss of heat through the pipes and into the ambient atmosphere surrounding the pipes. When the faucet is not in use, water sits in the hot water pipes. Water sitting in the hot water pipes, by nature of the fact that such water spends increased time in the pipes, experiences a larger amount of heat loss than continuously running water.

When a user activates the faucet and calls for hot water, cooled water in the hot water pipes is often initially delivered to the user. Typically, the user will allow the cooled water to drain while waiting for the requested hot water. This results in the waste of the cooled water.

As such, there is a need to provide a method and apparatus to keep water in hot water pipes heated to prevent water waste.

According to an illustrated embodiment of the present disclosure, a faucet assembly comprises a fluidway, cold and hot fluid supply lines fluidly coupled to the fluidway, and an auxiliary fluid line in thermal communication with a reservoir of heated fluid. A valve is in fluid communication with the hot fluid supply line, the auxiliary fluid line, and the fluidway.

According to a further illustrated embodiment of the present disclosure, a method of providing heated fluid to a faucet assembly includes the steps of providing a hot fluid supply line fluidly coupled to a hot fluid supply, providing an auxiliary fluid line, placing the auxiliary fluid line at least partially in a reservoir of heated fluid, and coupling the hot fluid supply line and the auxiliary fluid line to a valve. The valve is configured to draw fluid from the auxiliary fluid line when fluid within the hot fluid supply line has a temperature below a desired temperature.

In another illustrated embodiment of the present disclosure, a faucet assembly comprises a waterway, cold and hot water supply lines fluidly coupled to the waterway, and an auxiliary water line fluidly coupled to the hot water supply line. The auxiliary water line is at least partially located within a reservoir of heated water.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
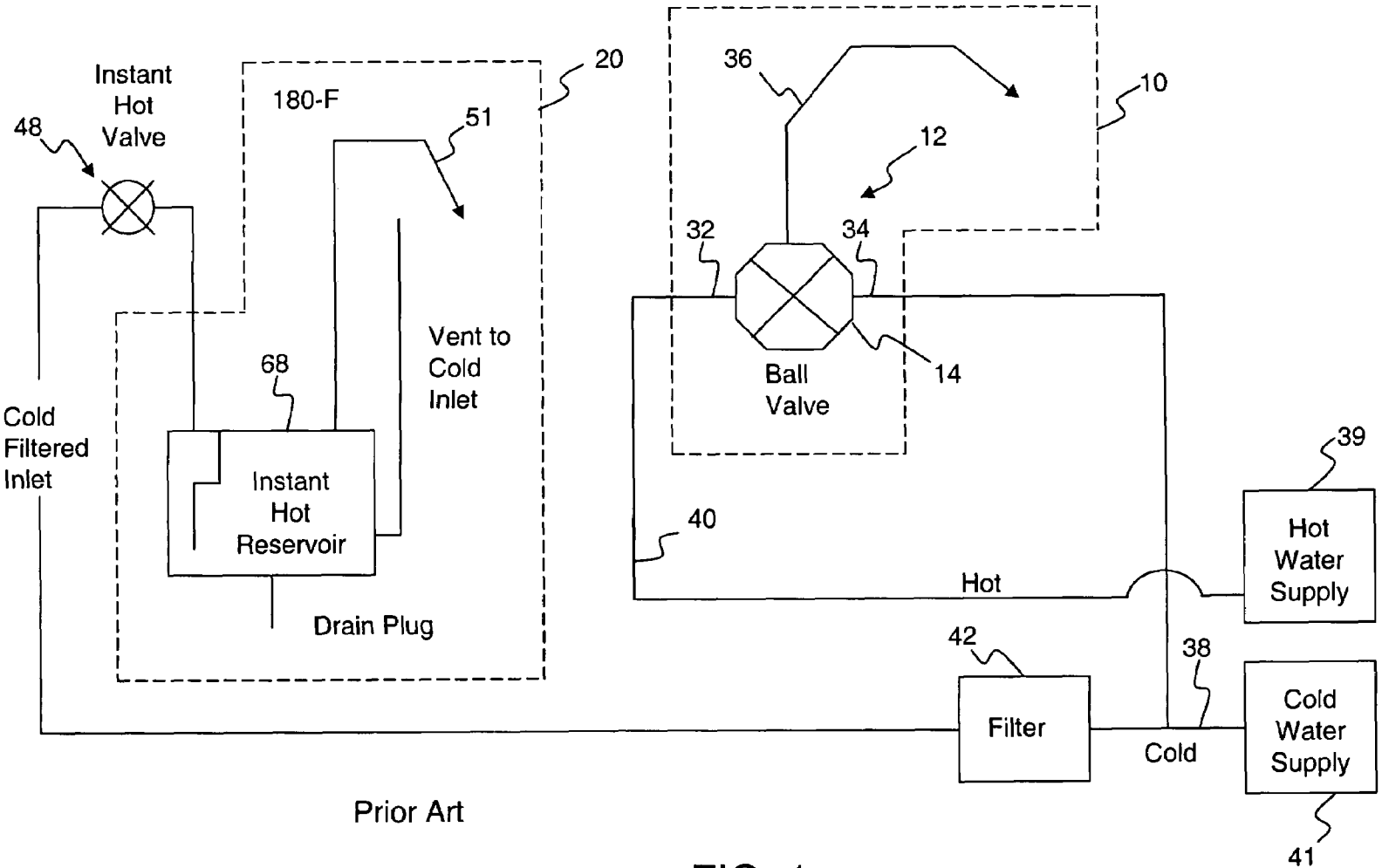
FIG. 1 Prior Art
FIG. 1 is a block diagram of a prior art faucet and instant hot device.

Referring initially to FIG. 1, a conventional faucet 10 and a conventional instant hot device 20 are shown. Faucet 10 is shown as single handle embodiment including a waterway 12 operably coupled to a ball valve 14. Waterway 12 includes hot and cold arms 32 and 34 and a spout leg 36. At the free end of the spout leg 36 is a discharge head in which is disposed an aerator (not shown). The first and second arms 32 and 34 of the waterway 12 are fluidly coupled to valve 14 that controls delivery of water to the spout leg 36. More particularly, the handle is operably coupled to the valve 14 for controlling the flow of water from the arms 32 and 34 to the spout leg 36.

While the illustrated embodiment describes a single handle operably coupled to valve 14, it should be appreciated the present invention may also be used with faucet assemblies including two handles operably coupled to a pair of valve assemblies (not shown). For example, the present invention may be used in connection with the two handle faucet detailed in U.S. Patent Application Ser. No. 10/411,432, filed Apr. 10, 2003, which is assigned to the assignee of the present invention and is expressly incorporated by reference herein.

Arms 32, 34 are connected, through conventional fittings (not shown), to conventional water supply tubes 38, 40 under a mounting deck (not shown). Hot water supply tube 40 runs from a hot water supply 39, illustratively a water heater, to arm 32. Cold water supply tube 38 runs from a cold water supply 41, possibly through an intermediate water softener (not pictured), to arm 34.

Additionally, cold supply tube 38, via conventional water filter 42, feeds an inlet valve 48 of the instant hot device 20. Instant hot device 20 provides a reservoir 68 of water that is kept at a temperature of approximately 180° F. Instant hot device 20 includes a spout 51 to selectively allow outflow of the 180° F. water from the reservoir 68.

Such an instant hot device 20 may be of the type disclosed in U.S. Pat. No. 6,094,524, U.S. Pat. No. 5,678,734, and U.S. Pat. No. 5,072,717, the disclosures of which are expressly incorporated by reference herein.

Figure 2:
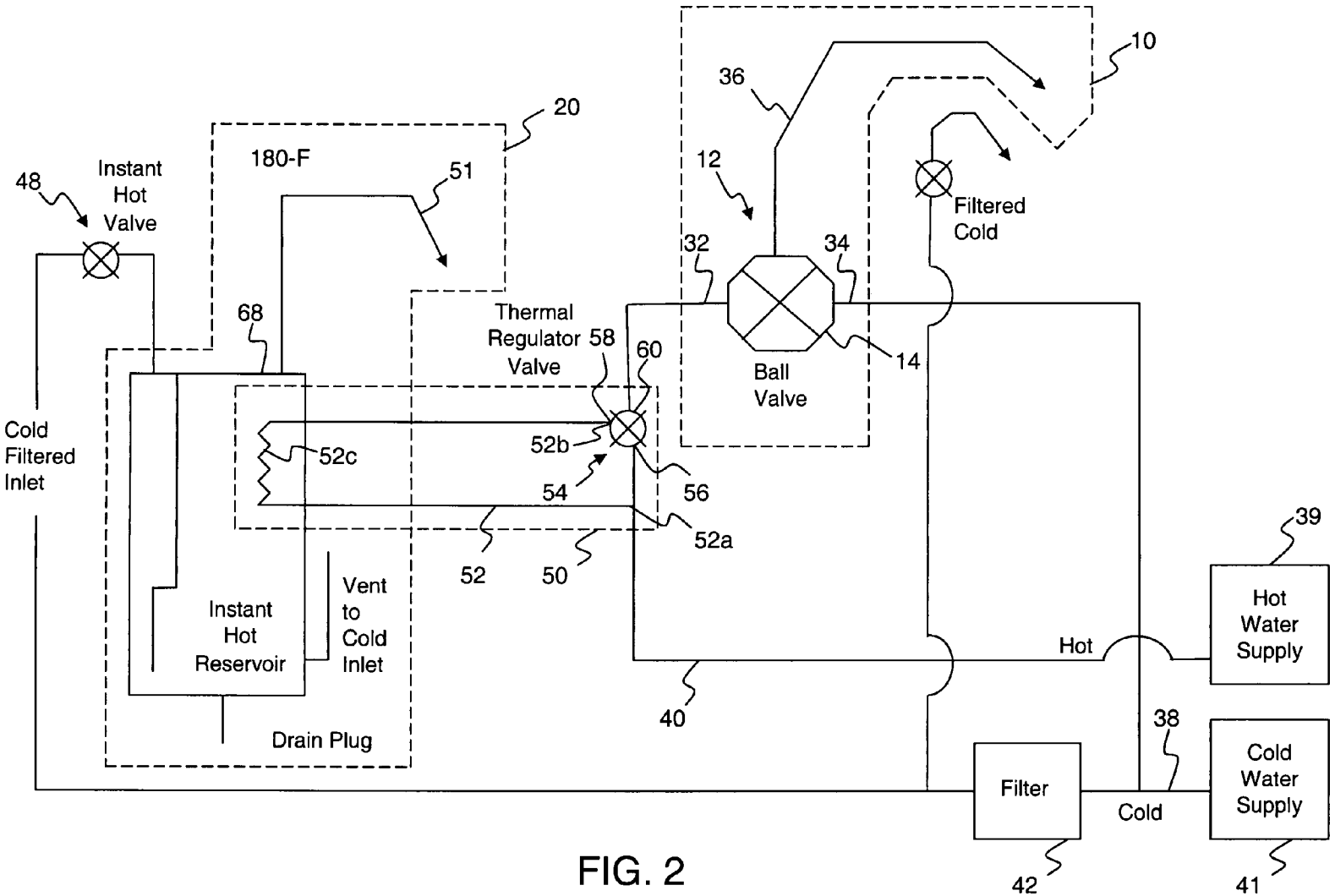
FIG. 2 is a block diagram of a first embodiment of the disclosure having a selectively engaged heat exchanger.

FIG. 2 shows a first embodiment heat exchanger 50 for use with faucet 10 and instant hot device 20. Heat exchanger 50 includes an auxiliary fluid line or tubing 52 and a thermal regulator valve 54. Tubing 52 is preferably copper tubing or any other tubing providing for relatively efficient heat transfer through conduction. Tubing 52 includes a first end 52*a* coupled to hot water supply line 40 and a second end 52*b* coupled to valve 54. Furthermore, tubing 52 includes an intermediate portion 52*c* which is routed through instant hot reservoir 68 and is at least partially submerged in the heated water contained in the reservoir 68. Water in tubing 52 preferably does not mix with water in instant hot reservoir 68. However, thermal energy within reservoir 68 is transferred through tubing 52 to the water therein to maintain the water at an elevated temperature. In order to facilitate heat transfer, the intermediate portion 52*c* illustratively includes an increased outer surface area provided by a plurality of loops or coils. The loops or coils in the intermediate portion 52*c* also provide for additional storage capacity of water therein.

Thermal regulator valve 54 illustratively comprises a thermostatic valve. Valve 54 includes a main input 56 from hot supply tube 40, an auxiliary input 58 from second end 52*b* of tubing 52, and an output 60. Valve 54 mixes water from each input 56, 58 and outputs the mixture through output 60. Output 60 is coupled to hot arm 32 of faucet 10.

Valve 54 senses the temperature of the water at inputs 56 and 58 and adjusts the output mixture in response thereto. In a default state, valve 54 passes only water from input 56 to output 60. However, if the water at input 56 has cooled appreciably from a desired supply temperature, then the valve 54 begins to take water from input 58, mix it with water from input 56, and provide the mixture to output 60. Water from input 58 is water that has been maintained in a state of elevated temperature by instant hot reservoir 68. Thus, the mixture supplied to hot arm 32 more closely approximates the desired temperature of un-cooled water from hot supply line 40.

As water in the cooled hot supply line 40 is used, heated water migrates up hot supply line 40 from the hot water supply 39. If the water in cooled hot supply line 40 has lost sufficient thermal energy, then valve 54 will take an increased amount of water from tubing 52 for the water mixture provided at output 60. Preferably, the maximum amount of water allowed to be taken from tubing 52 for the mixture at output 60 is such that the heated water in tubing 52 will not be exhausted before the properly heated water migrates up hot supply line 40 and arrives at valve 54. If the heated water in tubing 52 is used up before properly heated water arrives in hot supply line 40, valve 54 will output a heated water stream followed by a temporary drop in temperature during the time between when the water in line 52 expires and when the sufficiently heated water in hot supply line 40 arrives. If the water in hot supply line 40 has only cooled a small amount, then only a small amount of water from tubing 52 is added into the mixture. In an alternative embodiment, the amount of water in tubing 52 is designed to be completely exhausted each time faucet 10 is used. When the sufficiently heated water from hot supply line 40 arrives at valve 54, the water is sensed by valve 54 which passes water from input 56 directly to output 60 without any mixing with water from tubing 52 at input 58.

Figure 3:
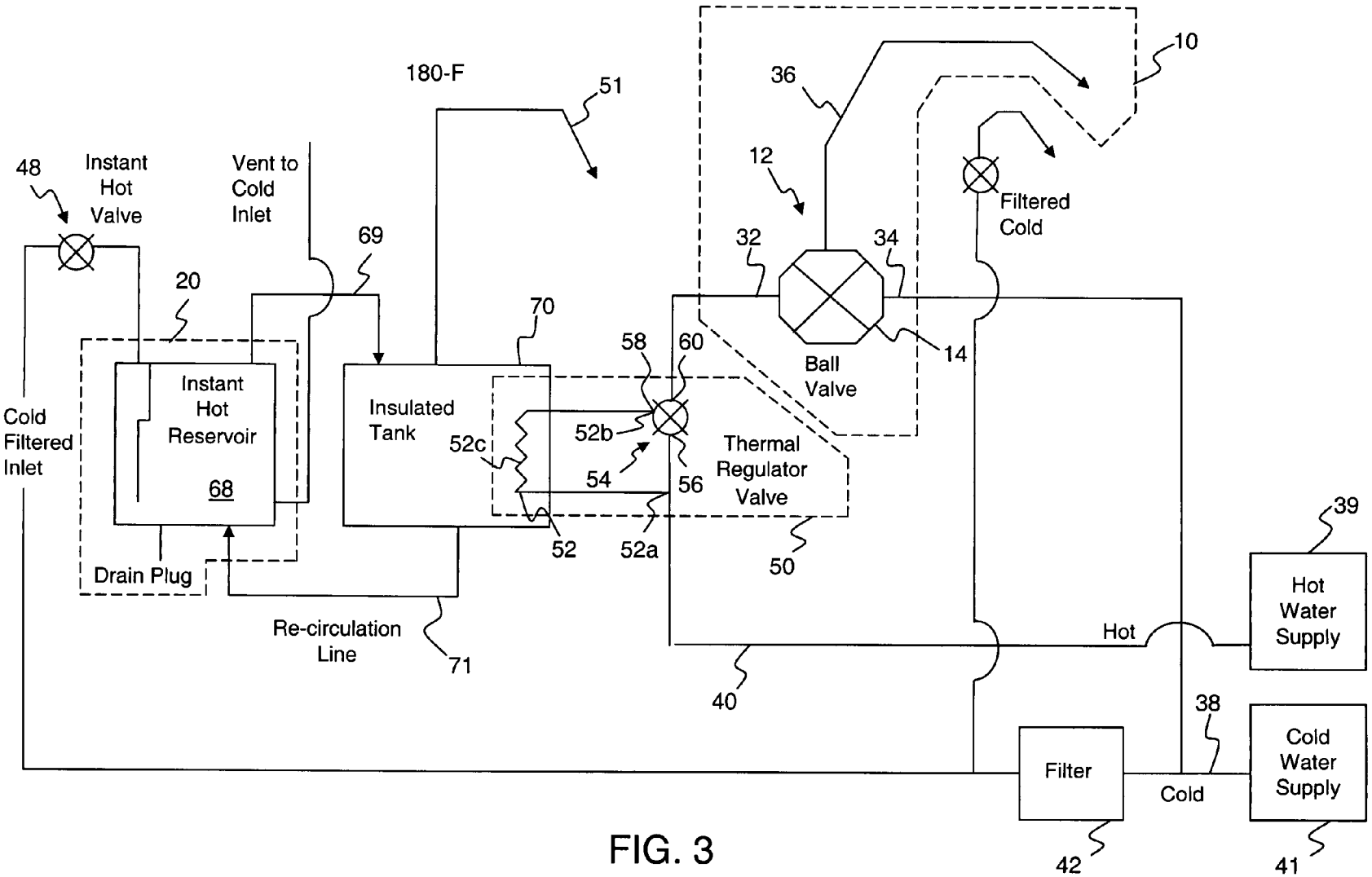
FIG. 3 is a block diagram of a second embodiment of the disclosure having a selectively engaged heat exchanger.

FIG. 3 shows an alternative embodiment of heat exchanger 50. An insulated tank 70 is located remotely from instant hot reservoir 68. Tank 70 receives hot water from instant hot reservoir 68 through supply line 69, recirculates water back to instant hot reservoir 68 through recirculation line 71, supplies instant hot spout 51, and receives intermediated portion 52*c* of tubing 52 therein. The embodiment of FIG. 3 functions similarly to the embodiment of FIG. 2, with the difference being that tubing 52 is within and receives thermal energy from tank 70 rather than directly from instant hot reservoir 68.

In a further alternative embodiment, input 58 of valve 54 may be directly fed from instant hot reservoir 68. In such an embodiment, valve 54 mixes water from instant hot reservoir 68 (preferably at 180° F.) and water within hot supply tub 40 until sufficiently heated water arrives through hot supply tube 40. Such an embodiment may also include a pressurization device for the water from hot reservoir 68 in that such reservoirs 68 are often unpressurized. It should be appreciated that the forgoing embodiments can be part of an initial faucet 10 installation. Alternatively, heat exchanger 50 can be attached to a previously installed hot supply line 40 and instant hot device 20.

Furthermore, while valve 54 has been described as sensing temperature at inputs 56, 58, additional embodiments are envisioned where temperature is sensed at output 60. The mix of water from inputs 56, 58 is then altered based on the temperature sensed at 60 to ensure a desired output temperature.

Although the invention has been described in detail with reference to certain preferred embodiments, variations and modifications exist within the spirit and scope of the invention as described and defined in the following claims.

The invention claimed is:

1. A method of providing heated fluid to a faucet assembly, the method including the steps of:

providing a hot fluid supply line fluidly coupled to a hot fluid supply;

providing an auxiliary fluid line;

placing the auxiliary fluid line at least partially in a reservoir of heated fluid;

coupling the hot fluid supply line and the auxiliary fluid line to a temperature responsive valve;

detecting a temperature of fluid within the hot fluid supply line; and drawing fluid from the auxiliary fluid line through the valve and to the faucet assembly in response to the detected temperature being below a desired temperature.

2. The method of claim 1, wherein the valve is a thermostatic valve.

3. The method of claim 1, wherein the fluid in the auxiliary line is fluidly isolated from the fluid in the reservoir.

4. The method of claim 1, wherein the valve selectively mixes fluid from the hot fluid line with fluid from the auxiliary fluid line.

5. The method of claim 1, wherein the valve outputs fluid to a faucet assembly.

6. The method of claim 1, wherein the auxiliary fluid line is fluidly coupled to the hot fluid supply line.

7. The method of claim 1, wherein the amount of fluid drawn from the auxiliary fluid line is proportional to a temperature differential between the temperature of fluid within the hot fluid supply line and a predetermined temperature.

8. A faucet assembly comprising:

a fluidway including a spout leg, a cold arm coupled to the spout leg, and a hot arm coupled to the spout leg;

a cold fluid supply line fluidly coupled to the cold arm of the fluidway;

a hot fluid supply line fluidly coupled to the hot arm of the fluidway;

an auxiliary fluid line coupled to the fluidway and in thermal communication with a reservoir of heated fluid;

at least one control valve in fluid communication with the spout leg, the at least one control valve being configured to control the flow of water from the cold arm and the hot arm to the spout leg; and a thermal regulator valve in fluid communication with the hot fluid supply line, the auxiliary fluid line, and the fluidway, the valve being configured to mix fluid from the hot fluid supply line and the auxiliary fluid line to provide a mixed water to the fluidway.

9. The assembly of claim 1, wherein the fluid in the auxiliary fluid line is fluidly isolated from fluid in the reservoir.

10. The assembly of claim 1, wherein the auxiliary fluid line is at least partially submersed within the heated fluid in the reservoir.

11. The assembly of claim 1, wherein the auxiliary fluid line conducts thermal energy from the reservoir to fluid within the auxiliary fluid line.

12. The assembly of claim 1, wherein the valve is a thermostatic valve.

13. The assembly of claim 1, wherein the valve is configured to draw fluid from the auxiliary fluid line only when fluid within the hot fluid supply line is below a desired fluid temperature.

14. The assembly of claim 13, wherein the amount of fluid drawn from the auxiliary fluid line is proportional to a temperature differential between the temperature of fluid within the hot fluid supply line and a predetermined temperature.

15. A faucet assembly comprising:

a waterway including a first spout;

an instant hot device including a reservoir of heated water and a second spout fluidly coupled to the reservoir of heated water;

a cold water supply line fluidly coupled to the waterway;

a hot water supply line fluidly coupled to the waterway; and an auxiliary water line fluidly coupled to the hot water supply line, auxiliary water line being at least partially located within the reservoir of heated water, wherein the auxiliary water line is in fluid communication with the first spout of the waterway.

16. The faucet of claim 15, wherein the reservoir of heated water is at atmospheric pressure.

17. The faucet of claim 15, wherein the auxiliary water line is positioned to draw thermal energy from the reservoir of heated water.

18. The faucet of claim 15, wherein the water from the reservoir of heated water is fluidly isolated from the auxiliary water line.

19. The faucet of claim 15, further comprising a valve configured to pass water from the auxiliary water line to the waterway when water in the hot water supply line is below a desired temperature.

20. The faucet of claim 19, wherein the valve is further configured to pass water from the hot water supply line to the waterway when water in the hot water supply line is at least as great as the desired temperature.

* * * * *